US006725816B2

(12) United States Patent
Yamaki et al.

(10) Patent No.: US 6,725,816 B2
(45) Date of Patent: Apr. 27, 2004

(54) APPARATUS FOR AND METHOD OF CONTROLLING SOLENOID-OPERATED VALVE DEVICE, AND RECORDING MEDIUM STORING CONTROL PROGRAM FOR SOLENOID-OPERATED VALVE DEVICE

(75) Inventors: Toshihiro Yamaki, Wako (JP); Kenji Abe, Wako (JP); Minoru Nakamura, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 182 days.

(21) Appl. No.: 10/004,153

(22) Filed: Nov. 15, 2001

(65) Prior Publication Data

US 2002/0056423 A1 May 16, 2002

(30) Foreign Application Priority Data

Nov. 15, 2000 (JP) ..... 2000-347478

(51) Int. Cl.[7] ..... F01L 9/04

(52) U.S. Cl. ..... 123/90.11; 251/129.1; 123/90.15

(58) Field of Search ..... 123/90.11, 90.12; 251/129.01, 129.1, 129.15, 129.16

(56) References Cited

U.S. PATENT DOCUMENTS 4,614,170 A 9/1986 Pischinger et al.
6,279,524 B1 * 8/2001 Schebitz ..... 123/90.11
6,354,253 B1 * 3/2002 Katsumata et al. ..... 123/90.11
6,390,036 B1 * 5/2002 Yuuki ..... 123/90.11

FOREIGN PATENT DOCUMENTS

JP 59-213913 12/1984
JP 10-288014 10/1998

* cited by examiner

*Primary Examiner*—Thomas Denion
*Assistant Examiner*—Jaime Corrigan
(74) *Attorney, Agent, or Firm*—Lahive & Cockfield, LLP; Anthony A. Laurentano

(57) ABSTRACT

In an alternate energization process for alternately energizing a valve closing electromagnet and a valve opening electromagnet periodically, one of the valve opening electromagnet and the valve closing electromagnet is de-energized and thereafter the other electromagnet is de-energized at a time delayed by a predetermined time Toff. The alternate energization process is finished when the displaced position of a valve head which is detected by a displacement sensor has reached a predetermined position Vinit while the valve opening electromagnet is being energized. Thereafter, the valve opening electromagnet is continuously energized to seat the valve head in a closed position (initial position) from the time when the displaced position of the valve head has reached a predetermined position Vstart.

21 Claims, 6 Drawing Sheets

APPARATUS FOR AND METHOD OF CONTROLLING SOLENOID-OPERATED VALVE DEVICE, AND RECORDING MEDIUM STORING CONTROL PROGRAM FOR SOLENOID-OPERATED VALVE DEVICE

BACKGROUND OF THE INVENTION

1. Field of the Invention

The present invention relates to an apparatus for and a method of controlling a solenoid-operated valve device for use as an intake or exhaust valve device in an internal combustion engine.

2. Description of the Related Art

There have heretofore been known solenoid-operated valve devices for use as intake or exhaust valves device in internal combustion engines. The basic structure of a conventional solenoid-operated valve device of the type described is shown in FIG. 1 of the accompanying drawings.

FIG. 1 illustrates a solenoid-operated valve device for use as an intake or exhaust valve device in an internal combustion engine. As shown in FIG. 1, the solenoid-operated valve device has a valve head 3 mounted on one end of a shank 3*a* and a plate-like armature 4 made of a magnetic material such as iron or the like which is mounted on the other end of the shank 3*a*. The valve head 3 serves to selectively open and close a port 2 as an intake port or an exhaust port (hereinafter referred to as "intake/exhaust port 2") of a combustion chamber 1 of each of the cylinders of an internal combustion engine. The valve head 3 is vertically reciprocally movable, together with the armature 4 along the axis of the shank 3*a*, between a closed position in which it closes the intake/exhaust port 2 and an open position in which it fully opens the intake/exhaust port 2.

Another solenoid-operated valve device also has a drive rod (not shown) held in concentric contact with the upper end of a valve stem and movable in unison with the valve stem, with an armature being mounted on the drive rod. In this solenoid-operated valve device, the valve stem and the drive rod jointly correspond to the shank 3*a* shown in FIG. 1.

Electromagnets 5, 6 having respective solenoids 5*a*, 6*a* housed therein are disposed above and below the armature 4 in confronting relation to each other. When the solenoid 5*a* is energized, the electromagnet 5 serves as a valve closing electromagnet which moves the armature 4 upwardly together with the valve head 3 and attracts the armature 4 under electromagnetic forces, thereby moving the valve head 3 into the closed position. When the solenoid 6*a* is energized, the electromagnet 6 serves as a valve opening electromagnet which moves the armature 4 downwardly together with the valve head 3 and attracts the armature 4 under electromagnetic forces, thereby moving the valve head 3 into the open position.

A spring 7 for urging the armature 4 and the valve head 3 in the direction to open the valve head 3, i.e., in the downward direction, is disposed above the armature 4, and a spring 8 for urging the armature 4 and the valve head 3 in the direction to close the valve head 3, i.e., in the upward direction, is disposed beneath the armature 4. When the electromagnets 5, 6 are de-energized, the valve head 3 is kept in a neutral position shown as the solid-line position in FIG. 1 between the closed position and the open position under the biasing forces of the springs 7, 8 which are held in equilibrium. Thus, the springs 7, 8 jointly function as a biasing means for urging the valve head 3 in the neutral position.

With the above solenoid-operated valve device, it is necessary to determine a position to which the valve head 3 is to move before the solenoid-operated valve device starts operating with the internal combustion engine. To meet such a requirement, before the internal combustion engine starts operating, the valve head 3 is moved to an initial position, which is either the open position or the closed position, from the neutral position in which the valve head 3 is kept when the electromagnets 5, 6 are de-energized. Such a moving process is hereinafter referred to as "initial actuating process").

The solenoid-operated valve device is controlled in the initial actuating process as disclosed in Japanese laid-open patent publication No. 59-213913 and Japanese laid-open patent publication No. 10-288014, for example.

According to the disclosed control processes, the electromagnets 5, 6 are alternately periodically energized to generate alternate electromagnetic forces which vibrate the valve head 3 and the armature 4. The electromagnets 5, 6 are energized for a period of time which is half the period of the natural frequency (resonant frequency) of the spring-mass system comprising the valve head 3, the shank 3*a*, the armature 4, and the springs 7, 8, or which becomes closer stepwise from a period of time somewhat longer than half the period to half the period, thus progressively increasing the amplitude of the vibrations of the valve head 3, etc. based on the resonance of the spring-mass system. When the amplitude of the vibrations of the valve head 3, etc. becomes sufficiently large, the alternate energization of the electromagnets 5, 6 is finished, and only the electromagnet 5 or 6 corresponding to the initial position (the open or closed position) of the valve head 3 is continuously energized. The electromagnetic forces generated by the electromagnet 5 or 6 corresponding to the initial position attract the armature 4, seating the valve head 3 in the initial position.

According to Japanese laid-open patent publication No. 59-213913, the arrival of the valve head 3 at the open or closed position due to the alternate energization of the electromagnets 5, 6 is recognized based on a reduction in the current passing through the electromagnet 5 or 6, and the alternate energization of the electromagnets 5, 6 is finished when the arrival of the valve head 3 at the open or closed position is recognized. According to Japanese laid-open patent publication No. 10-288014, when the electromagnets 5, 6 are alternately energized a predetermined number of times, the amplitude of the vibrations of the valve head 3, etc. is regarded as being sufficiently large, and the alternate energization of the electromagnets 5, 6 is finished.

According to the disclosed arrangements, since the resonance of the spring-mass system is utilized, the initial actuating process may be performed with a smaller current supplied to the electromagnets 5, 6 than if only the electromagnet 5 or 6 corresponding to the initial position were continuously energized to move the valve head 3 to the initial position under electromagnetic forces generated by the electromagnet 5 or 6.

However, the disclosed processes have suffered the following drawbacks:

When the electromagnets 5, 6 are alternately energized in the initial actuating process, one of the electromagnets is de-energized and at the same time the other electromagnet is energized, and hence either one of the electromagnets is energized at all times (see FIGS. 2 and 3 of Japanese laid-open patent publication No. 59-213913 and FIG. 2 of Japanese laid-open patent publication No. 10-288014).

When the valve opening electromagnet 6, for example, is de-energized and the valve closing electromagnet 5 starts being energized, the armature 4 is spaced relatively widely from the valve closing electromagnet 5, and the electromagnetic forces of the valve closing electromagnet 5 do not well act on the armature 4. In this state, the armature 4 can move toward the valve closing electromagnet 5 under the bias of the springs 7, 8. This also holds when valve closing electromagnet 5 is de-energized and the valve opening electromagnet 6 starts being energized.

Therefore, when the electromagnets 5, 6 are alternately energized, supplied currents are often wasted in certain intervals as they do not contribute to the vibration of the valve head 3, etc., resulting in an excessive consumption of electric energy in the initial actuating process.

According to Japanese laid-open patent publication No. 10-288014, the alternate energization of the electromagnets 5, 6 is finished when they have been alternately energized a certain number of times. In view of variations of the properties of the springs 7, 8, variations of the friction of various parts at the time the valve head 3 is moved, or time-dependent changes thereof, the number of times that the electromagnets 5, 6 are alternately energized generally needs to be set to a relatively large value in order to seat the valve head 3 reliably after the alternate energization of the electromagnets 5, 6 is finished. Therefore, even when the valve head 3 vibrating due to the alternate energization fully reaches the open and closed positions, the electromagnets 5, 6 may remain continuously energized alternately. In this case, impact sounds are produced such as when the armature 4 hits the electromagnets 5, 6, generating noise, and the electromagnets 5, 6 may be alternately energized for an unnecessary long period of time, causing an unnecessary consumption of electric energy.

According to Japanese laid-open patent publication No. 59-213913, since the alternate energization of the electromagnets 5, 6 is finished when the valve head 3 reaches the initial position (the open or closed position), the impact sounds produced such as when the armature 4 hits the electromagnets 5, 6 are relatively large when the valve head 3 reaches the initial position.

SUMMARY OF THE INVENTION

It is therefore an object of the present invention to provide an apparatus for and a method of controlling a solenoid-operated valve device to reduce a consumption of electric energy by an electromagnet in an initial actuating process for moving a valve head from a neutral position to an initial position (an open or closed position).

Another object of the present invention is to provide an apparatus for and a method of controlling a solenoid-operated valve device to perform an initial actuating process efficiently and smoothly and prevent noise such as impact sounds from being produced when a valve head is seated, without alternately energizing a valve opening electromagnet and a valve closing electromagnet for an unnecessary long period of time.

Still another object of the present invention is to provide a recording medium which stores a control program for controlling a solenoid-operated valve device with a computer.

To achieve the above objects, there are provided an apparatus for and a method of controlling a solenoid-operated valve device having a valve head movable between an open position to open a fluid passage and a closed position to close the fluid passage, an armature of a magnetic material movable in unison with the valve head, a valve opening electromagnet energizable for generating electromagnetic forces to attract the armature in a direction to move the valve head toward the open position, a valve closing electromagnet energizable for generating electromagnetic forces to attract the armature in a direction to move the valve head toward the closed position, and biasing means for biasing the valve head into a neutral position between the open position and the closed position. An alternate energization process is performed to alternately energize the valve opening electromagnet and the valve closing electromagnet periodically to cause the valve opening electromagnet and the valve closing electromagnet to generate electromagnetic forces alternately to vibrate the valve head together with the armature with an increasing amplitude when the valve head is moved from the neutral position in which the valve head is kept by the biasing means to an initial position which is either one of the open position and the closed position.

According to the present invention, there is also provided a computer-readable recording medium storing a control program for enabling a computer to perform the above alternate energization process.

With the above apparatus and method, in the above alternate energization process, one of the valve opening electromagnet and the valve closing electromagnet is de-energized and thereafter the other of the valve opening electromagnet and the valve closing electromagnet is energized with a delay from the time to de-energize said one of the valve opening electromagnet and the valve closing electromagnet. The recording medium stores the program for enabling the computer to perform the above alternate energization process as the control program for the solenoid-operated valve device.

In the alternate energization process for alternately energizing the valve opening electromagnet and the valve closing electromagnet to vibrate the valve head together with the armature, one of the electromagnets is de-energized at a time and the other electromagnet starts being energized with a delay from the time at which said one of the electromagnets is de-energized. Therefore, immediately after said one of the electromagnets is de-energized (before the other electromagnet starts being energized), the armature moves in unison with the valve head toward the other electromagnet under the bias of the biasing means. When the armature has moved to a certain position closer to the other electromagnet under the bias of the biasing means, the other electromagnet starts to be energized. With the recording medium according to the present invention, the above energization of the electromagnet is performed under the control of the computer.

After said one of the electromagnets is de-energized, while the armature can move smoothly toward the other electromagnet under the bias of the biasing means, both of the electromagnets remain de-energized. When the armature moves to a certain position close to the other electromagnet and the electromagnetic forces from the other electromagnet can effectively act on the armature, the other electromagnet starts being energized.

As a result, in the alternate energization process for moving the valve head from a neutral position to the initial position (the open position or the closed position), the valve head can smoothly be vibrated as desired, and any wasteful energization of the electromagnets is avoided to reduce the consumption of electric energy by the electromagnets.

With the above apparatus and method, in the above alternate energization process, one of the valve opening electromagnet and the valve closing electromagnet is de-energized and, after elapse of a predetermined time, the other of the valve opening electromagnet and the valve closing electromagnet starts to be energized. With the recording medium according to the present invention, the control program stored therein is arranged to energize the electromagnet in the above fashion.

Therefore, the time to start energizing the other electromagnet after said one of the electromagnets is de-energized can easily be delayed. The predetermined time which determines the time to start energizing the other electromagnet should preferably be established such that after said one of the electromagnets is de-energized, the valve head starts moving in a direction opposite to the direction in which it is attracted by said one electromagnet, under the bias of the biasing means, and the other electromagnet starts being energized while the valve head is moving toward the neutral position. The predetermined time should preferably be established such that the sum of the time in which said one electromagnet is energized and the predetermined time is about half the period of the natural frequency of a system comprising the valve head, the armature, the biasing means, etc., i.e., a spring-mass system.

According to another aspect of the control apparatus, the solenoid-operated valve device has a displacement sensor for generating an output signal depending on the position to which the valve head is moved, and one of the valve opening electromagnet and the valve closing electromagnet is de-energized and thereafter the other of the valve opening electromagnet and the valve closing electromagnet starts to be energized from the time when the position to which the valve head is moved, represented by the output signal from the displacement sensor (the detected position to which the valve head is moved), has reached a first displaced position between the open position and the closed position in the alternate energization process.

According to another aspect of the control method, the method has the step of sequentially detecting the position to which the valve head is moved based on an output signal from a displacement sensor, which is provided in the solenoid-operated valve device to detect the position to which the valve head is moved, at least after the alternate energization process has been started, and one of the valve opening electromagnet and the valve closing electromagnet is de-energized and thereafter the other of the valve opening electromagnet and the valve closing electromagnet starts to be energized from the time when the detected position to which the valve head is moved has reached a first displaced position between the open position and the closed position in the alternate energization process.

According to another aspect of the recording medium, the computer is capable of detecting the position to which the valve head is moved based on an output signal from a displacement sensor, which is provided in the solenoid-operated valve device to detect the position to which the valve head is moved, and the control program is arranged to de-energize one of the valve opening electromagnet and the valve closing electromagnet and thereafter start to energize the other of the valve opening electromagnet and the valve closing electromagnet from the time when the detected position to which the valve head is moved has reached a first displaced position between the open position and the closed position in the alternate energization process.

After said one electromagnet is de-energized, the other electromagnet starts to be energized from the time when the actual position to which the valve head is moved as detected by the displacement sensor reaches the first displaced position under the bias of the biasing means and is confirmed as having moved a certain extent closely to one of the open and closed positions which is attracted by the other electromagnet. Therefore, the other electromagnet starts to be energized at a suitable delay time to smoothly vibrate the valve head regardless of variations of the properties of the biasing means, variations of the friction of various parts, and time-dependent changes thereof.

The first displaced position may be set to a common displaced position (e.g., a position near the neutral position) when the valve head moves from the open position to the closed position and when the valve head moves from the closed position to the open position in the alternate energization process. Basically, it is preferable to establish the first displaced position differently when the valve head moves from the open position to the closed position and when the valve head moves from the closed position to the open position. Specifically, when the valve head moves from the open position to the closed position, i.e., after the valve opening electromagnet is de-energized, the first displaced position should preferably be slightly closer to the open position than the neutral position, and when the valve head moves from the closed position to the open position, i.e., after the valve closing electromagnet is de-energized, the first displaced position should preferably be slightly closer to the closed position than the neutral position.

A solenoid-operated valve device for use as an intake or exhaust valve device in an internal combustion engine usually has a displacement sensor for generating an output signal depending on the position to which the valve head is moved in order to control operation of the solenoid-operated valve device while the internal combustion engine is operating. Such a solenoid-operated valve device does not need to have a new displacement sensor.

With the above apparatus and method, the alternate energization process is finished when the position to which the valve head is moved, represented by the output signal from the displacement sensor (the detected position to which the valve head is moved), has reached a second displaced position located closer to either one of the open position and the closed position and between the open position and the closed position after the alternate energization process has been started, and, after the alternate energization process is finished, a valve seating process is performed to continuously energize one of the valve opening electromagnet and the valve closing electromagnet which corresponds to the initial position in order to keep the valve head in the initial position. If the solenoid-operated valve device does not have its own displacement sensor, then a displacement sensor for generating an output signal depending on the position to which the valve head is moved is added to the solenoid-operated valve device, and the above alternate energization process and valve seating process is carried out. The control program stored in the recording medium includes a program for enabling the computer to perform the above alternate energization process and valve seating process.

After the alternate energization process has been started, when the position to which the valve head is moved as detected by the displacement sensor has reached a predetermined position (the second displaced position) near the open position or the closed position, i.e., when the amplitude of actual vibrations of the valve head is confirmed as being sufficiently large in the alternate energization process, the alternate energization process is finished, and the valve seating process is initiated. Consequently, the alternate energization process is finished within a minimum time required and then valve seating process is initiated to hold the valve head in the initial position regardless of variations of the properties of the biasing means, variations of the friction of various parts, and time-dependent changes thereof.

As a result, the time in which the alternate energization process is carried out is held to a minimum required, and operation of the solenoid-operated valve device in the alternate energization process and the valve seating process, i.e., the initial actuating process of the solenoid-operated valve device, can efficiently be performed, and the total amount of electric energy consumed by the valve opening electromagnet and the valve closing electromagnet in the alternate energization process can be reduced. By setting the second displaced position to an appropriate position, it is possible to finish the alternate energization process before the valve head whose vibrating amplitude progressively increases in the alternate energization process reaches the open position or the closed position. Accordingly, before the valve head reaches and is held in the initial position in the valve seating process, noise such as impact sounds which would otherwise be caused by the armature hitting the electromagnets is prevented from being produced.

With the apparatus and method according to the present invention which perform the valve seating process after the alternate energization process is finished, the valve seating process is performed by starting to energize the electromagnet corresponding to the initial position under constant voltage control when the position to which the valve head is moved, represented by the output signal from the displacement sensor, has reached a third displaced position located between the open position and the closed position while the valve head is moving toward the initial position after the alternate energization process has been finished, and then energizing the electromagnet corresponding to the initial position under constant current control when the position to which the valve head is moved has reached a fourth displaced position located closer to the initial position than the third displaced position and near the initial position, thus holding the valve head in the initial position. The control program stored in the recording medium is arranged to enable the computer to perform the above valve seating process.

In the valve seating process, when the valve head reaches the third displaced position upon movement toward the initial position, the electromagnet corresponding to the initial position is energized under constant voltage control, or specifically a control process to energize the solenoid thereof to apply a constant voltage to the solenoid. Therefore, as the armature approaches the electromagnet corresponding to the initial position, the current flowing through the electromagnet increases, and the electromagnetic forces generated thereby also increase, making it possible to move the valve head smoothly toward the initial position. When the valve head reaches the fourth displaced position near the initial position, i.e. immediately before the valve head reaches the initial position, the electromagnet corresponding to the initial position is energized under constant current control, or specifically a control process to energize the solenoid thereof to supply a constant current to the solenoid. Therefore, it is possible to seat the valve head smoothly in the initial position while reducing impact sounds caused when the armature hits the electromagnet corresponding to the initial position, and also to keep the valve head stably in the initial position with a relatively small current supplied to the electromagnet corresponding to the initial position.

Specifically, the third displaced position should preferably be set to a position located between the neutral position and the initial position, for example, but closer to the neutral position than the fourth displaced position.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
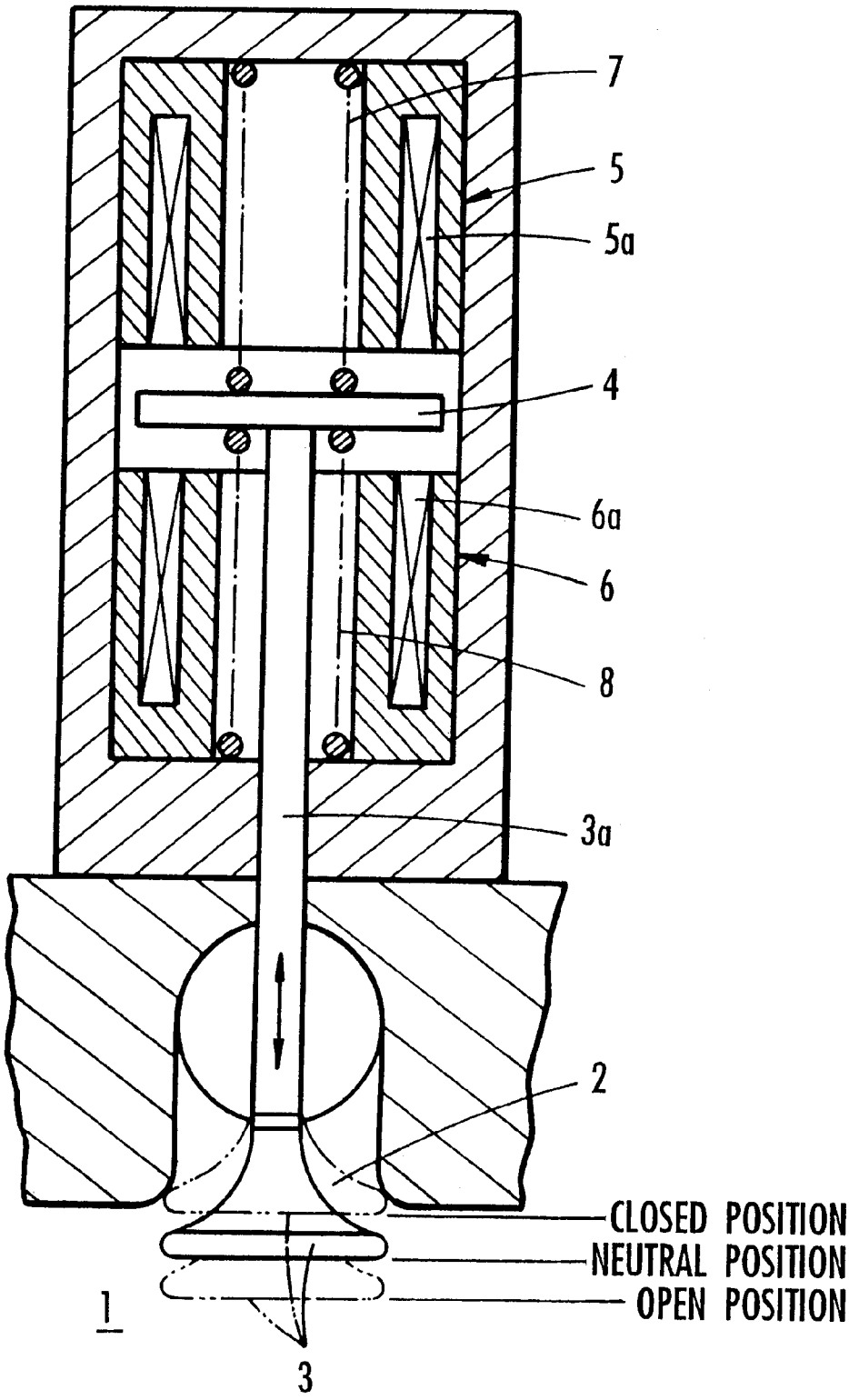
FIG. 1 is a longitudinal cross-sectional view showing a basic structure of a solenoid-operated valve device according to the present invention.
Figure 2:
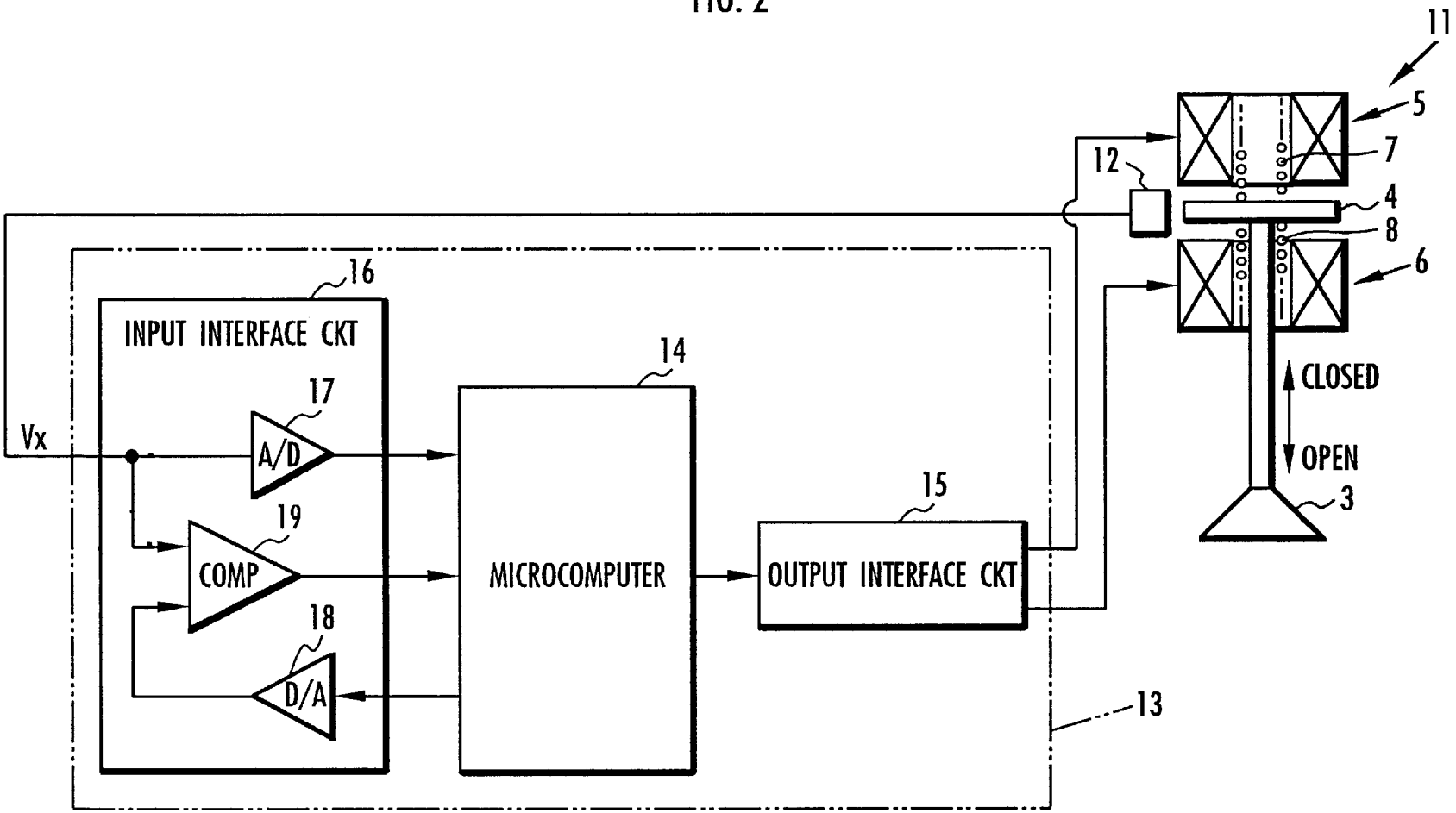
FIG. 2 is a block diagram of a control system for controlling the solenoid-operated valve device shown in FIG. 1.

A first embodiment of the present invention will be described below with reference to FIGS. 1 through 4. FIG. 2 shows in block form a control system for controlling a solenoid-operated valve device 11 according to the first embodiment of the present invention. The solenoid-operated valve device 11 is of a structure described above with reference to FIG. 1, and serves to selectively and close the intake/exhaust port 2 (the intake port or the exhaust port) as a fluid passage communicating with the combustion chamber 1 of each of the cylinders of an internal combustion engine. In FIG. 2, the solenoid-operated valve device 11 is shown as a simplified structure for the sake of brevity.

The control system according to the first embodiment of the present invention has a displacement sensor 12 associated with the solenoid-operated valve device 11 for generating an output signal Vx depending on the position to which the valve head 3 is moved, and a controller 13 for controlling energization of the solenoids 5*a*, 6*a* of the valve closing electromagnet 5 and the valve opening electromagnet 6 of the solenoid-operated valve device 11 based on the output signal Vx from the displacement sensor 12, for the purpose of performing an operation control process, including an initial actuating process described later on, of the solenoid-operated valve device 11.

The displacement sensor 12 may comprise an eddy-current sensor or a sensor of the type for detecting an inductance change. Since the output signal Vx from the displacement sensor 12 and the position to which the valve head 3 is moved are basically in one-to-one correspondence, the output signal Vx from the displacement sensor 12 is occasionally referred to as a detected position Vx of the valve head 3.

The controller 13 comprises a microcomputer 14 made up of a CPU, a RAM, and a ROM (not shown), an output interface circuit 15 as a drive circuit for energizing the electromagnets 5, 6 according to instructions from the microcomputer 14, and an input interface circuit 16 for supplying various data, including the output signal Vx from the displacement sensor 12, required for the control process performed by the computer 14 to the computer 14.

The input interface circuit 16 comprises an A/D converter 17 for converting the output signal Vx, which is an analog signal, into a digital signal and supplying the digital signal to the microcomputer 14, a D/A converter 18 for converting the digital data of a threshold (relative to the output signal Vx), to be described later on, outputted from the microcomputer 14 into analog data, and a comparator 19 for comparing analog output data as a level signal representing the threshold with the output signal Vx and supplying data depending on the result of the comparison to the microcomputer 14.

The microcomputer 14 stores a control program for controlling the energization of the electromagnets 5, 6 in its ROM, which serves as a recording medium according to the present invention.

The microcomputer 14 is also supplied with detected data representing the rotational speed of the internal combustion engine and other values for the control of the solenoid-operated valve device 11 during the operation of the internal combustion engine. However, such detected data will not be described below as they have no direct bearing on the present invention.

Operation of the control system, primarily the control process performed by the microcomputer 14, will be described below.

Before the internal combustion engine starts operating, the microcomputer 14 controls energization of the solenoids 5*a*, 6*a* of the valve closing and opening electromagnets 5, 6 for performing an initial actuating process to move the valve head 3 from the neutral position to the initial position which is the closed position and seat the valve head 3 in the initial position.

Figure 3:
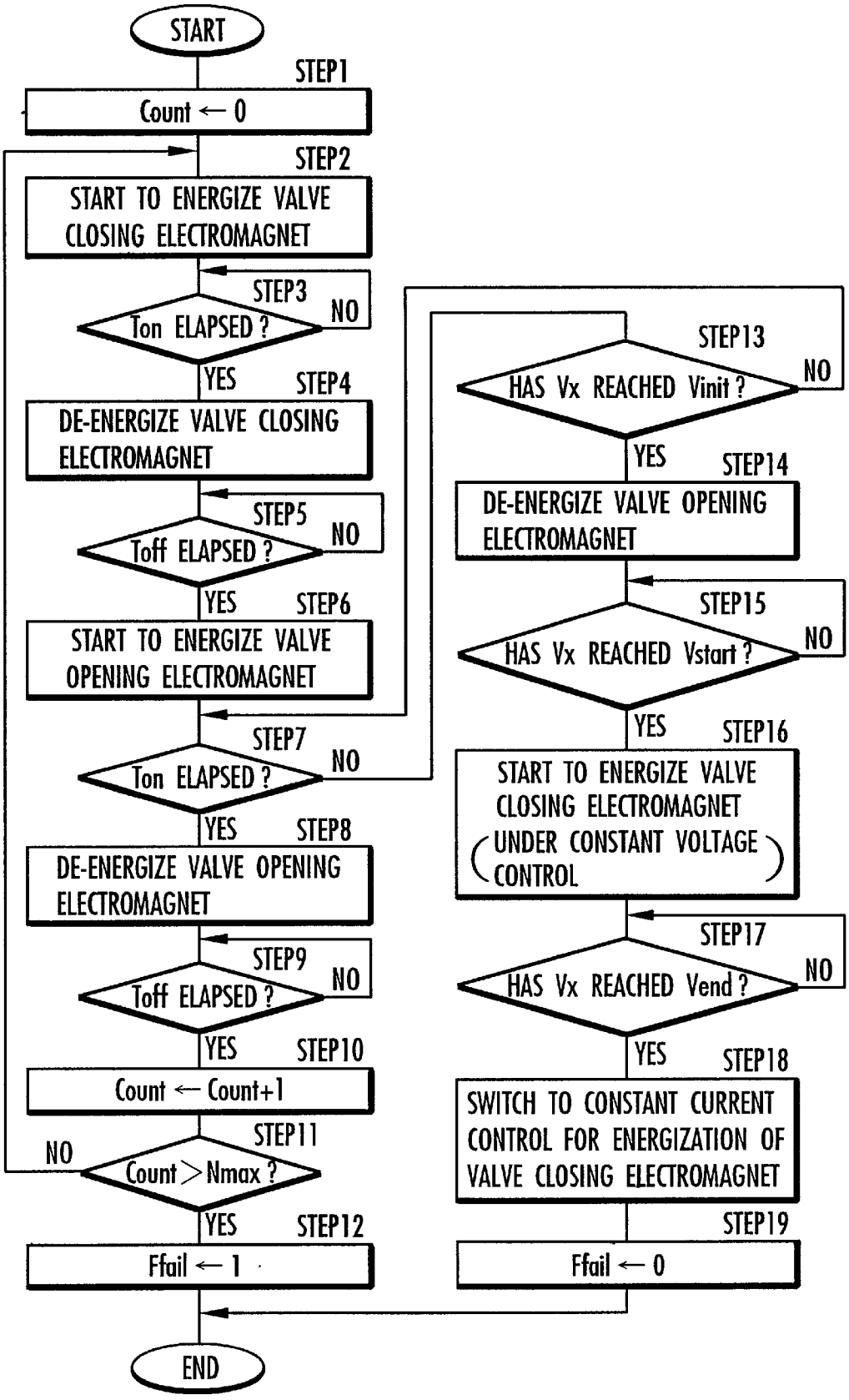
FIG. 3 is a flowchart of a control process according to a first embodiment of the present invention.
Figure 4:
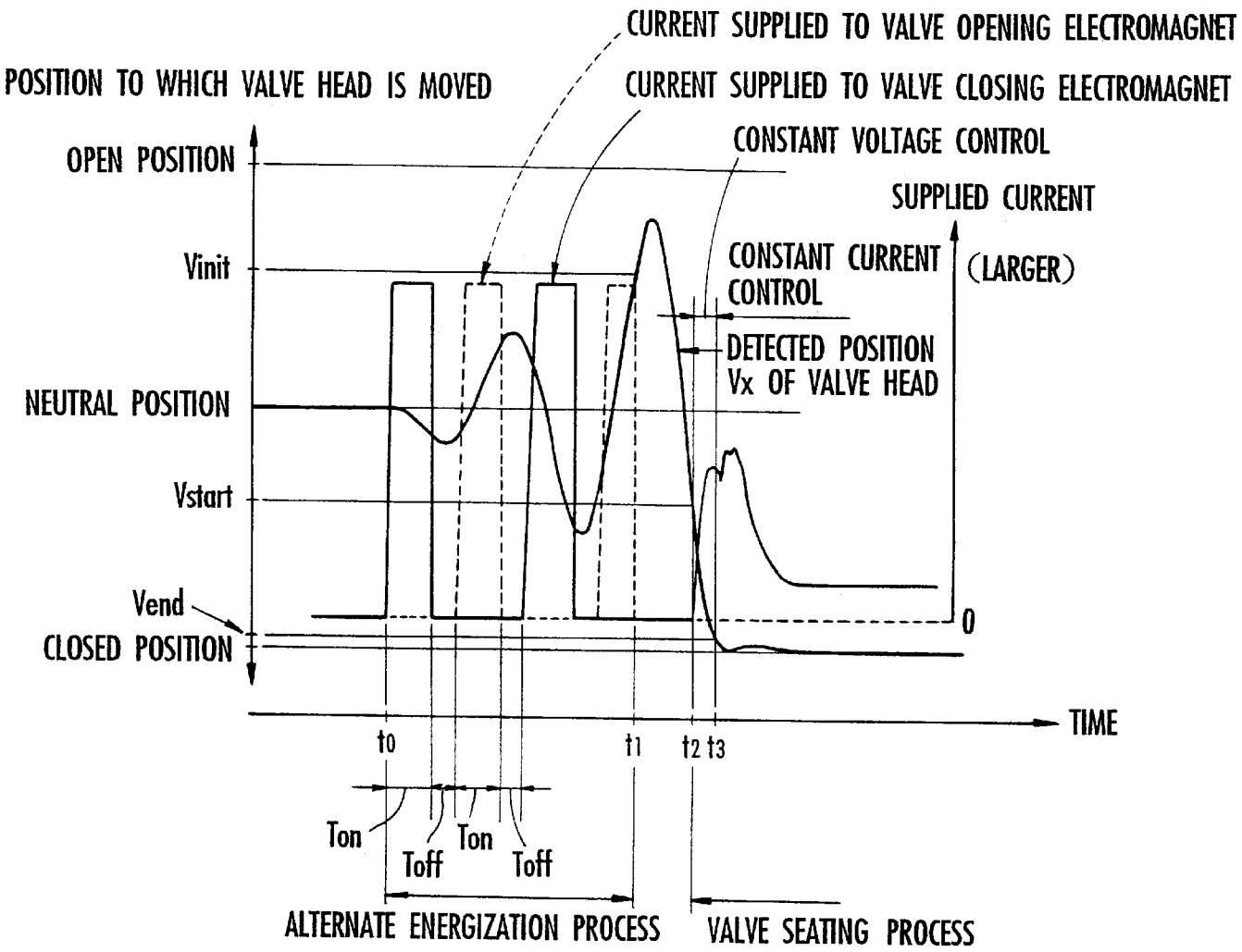
FIG. 4 is a timing chart illustrative of the control process according to the first embodiment of the present invention.

The initial actuating process is carried out as shown in a flowchart of FIG. 3 and a timing chart of FIG. 4. FIG. 3 shows the control process performed by the microcomputer 14 in the initial actuating process, and FIG. 4 illustrates how the currents supplied to the electromagnets 5, 6 change with time in the initial actuating process and the output signal Vx of the displacement sensor 12, i.e., the detected position Vx of the valve head 3, changes with time.

In the initial actuating process, as shown in FIG. 3, the microcomputer 14 de-energizes the valve closing and opening electromagnets 5, 6, and initializes the value of a counting parameter Count for counting the number of times that the electromagnets 5, 6 are alternately energized to "0" in STEP1.

Then, the microcomputer 14 performs the processing of a loop from STEP2 to STEP11 to alternately periodically energize the solenoids 5*a*, 6*a*, i.e., performs an alternate energization process.

Specifically, the microcomputer 14 starts energizing the solenoid 5*a* of the valve closing electromagnet 5 via the output interface circuit 15 in STEP2, and then monitors whether a predetermined energization time Ton has elapsed from the start of the energization of the valve closing electromagnet 5 or not in STEP3. At this time, the valve closing electromagnet 5 is energized under constant current control with a constant current supplied thereto.

If the energization time Ton has elapsed from the start of the energization of the valve closing electromagnet 5 in STEP3, then the microcomputer 14 de-energizes the valve closing electromagnet 5 in STEP4. The microcomputer 14 then monitors whether a predetermined delay time Toff has elapsed from the de-energization of the valve closing electromagnet 5 or not in STEP5.

If the delay time Toff has elapsed, then the microcomputer 14 starts energizing the solenoid 6*a* of the valve opening electromagnet 6 via the output interface circuit 15 in STEP6, and then monitors whether the energization time Ton has elapsed from the start of the energization of the valve opening electromagnet 6 or not in STEP7. At this time, the valve opening electromagnet 6 is energized under constant current control with a constant current supplied thereto. A decision process in STEP13 is carried out after the valve opening electromagnet 6 starts being energized in STEP 6 until the energization time Ton elapses. The decision process in STEP13 will be described in detail later on.

If the energization time Ton has elapsed from the start of the energization of the valve opening electromagnet 6 in STEP7, then the microcomputer 14 de-energizes the valve opening electromagnet 6 in STEP8. The microcomputer 14 then monitors whether the delay time Toff has elapsed from the de-energization of the valve opening electromagnet 6 or not in STEP9. If the delay time Toff has elapsed, then the microcomputer 14 increments the value of the counting parameter Count by "1" in STEP10. The microcomputer 14 then determines whether the value of the counting parameter Count has exceeded a predetermined upper limit value Nmax or not in STEP11. The microcomputer 14 repeats the processing from STEP2 until the value of the counting parameter Count exceeds the upper limit value Nmax (Count>Nmax).

If Count>Nmax in STEP11, then the microcomputer 14 sets a flag Ffail (hereinafter referred to as "error flag Ffail") to "1" in STEP12. The error flag Ffail represents an error in the initial actuating process when it is "1". Then, the initial actuating process is put to an end. At this time, the microcomputer 14 performs a failure process by indicating a failure of the solenoid-operated valve device 11 or carrying out the initial actuating process again.

In the processing of the loop from STEP2 to STEP11, the electromagnets 5, 6 are alternately energized in successive periods, each twice the sum (Ton+Toff) of the energization time Ton and the delay time Toff, as indicated by the waveforms of the currents supplied to the electromagnets 5, 6 in a period from a time t0 to a time t1 in FIG. 4. While the electromagnets 5, 6 are being energized, the electromagnets 5, 6 apply electromagnetic forces to the armature 4 to attract the armature 4 to themselves. As a result, the armature 4 and the valve head 3 are vertically moved from the neutral position under the electromagnetic forces and the biasing forces of the springs 7, 8.

In the present embodiment, the energization time Ton and the delay time Toff are selected such that the sum (Ton+Toff) of the energization time Ton and the delay time Toff, i.e., the time from the start of the energization of one of the electromagnets 5, 6 to the start of the energization of the other of the electromagnets 5, 6 (half the period of the alternate energization of the electromagnets 5, 6) is substantially equal to a time which is half the period of the natural frequency of the spring-mass system which comprises the valve head 3, the shank 3*a*, the armature 4, and the springs 7, 8. Basically, the valve closing electromagnet 5 is energized while the valve head 3 is moving toward the closed position. Specifically, the valve closing electromagnet 5 is energized while the valve head 3 is moving from the open position toward the neutral position under the bias of the springs 7, 8 after the energization of the valve opening electromagnet 6 is finished. The valve opening electromagnet 6 is energized while the valve head 3 is moving toward the open position. Specifically, the valve opening electromagnet 6 is energized while the valve head 3 is moving from the closed position toward the neutral position under the bias of the springs 7, 8 after the energization of the valve closing electromagnet 5 is finished.

Therefore, the spring-mass system resonates, vibrating the valve head 3 together with the armature 4 in substantial synchronism with the alternate energization of the electromagnets 5, 6, between the open position and the closed position with an increasing amplitude, as indicated by the waveform of the detected position Vx of the valve head 3 in FIG. 4. Stated otherwise, the valve head 3 moves from the neutral position toward the open position or the closed position while vibrating across the neutral position.

After one of the electromagnets 5, 6 is de-energized until the delay time Toff elapses, the armature 4 moves together with the valve head 3 toward the other of the electromagnets 5, 6 solely under the bias of the springs 7, 8. While the armature 4 is thus moving, the other electromagnet 5 or 6 starts being energized, applying electromagnetic forces to the armature 4 to attract the armature thereto.

Concurrent with the above alternate energization of the electromagnets 5, 6, the microcomputer 14 monitors the detected position Vx of the valve head 3 as detected by the displacement sensor 12 during the period from the start of the energization of the valve opening electromagnet 6 in STEP6 until the elapse of the energization time Ton, thus determining whether the detected position Vx has reached a predetermined displaced position Vinit near the open position (between the neutral position and the open position) as shown in FIG. 4 or not in STEP13. Specifically, the microcomputer 14 supplies the threshold data (digital data) for the output signal Vx of the displacement sensor 12 which corresponds to the displaced position Vinit to the D/A converter 18 of the input interface circuit 16, and monitors the output signal from the comparator 19 to perform the decision process in STEP13.

If the detected position Vx has not reached the displaced position Vinit (hereinafter referred to as "alternate energization finishing displaced position Vinit"), then control goes to STEP8 after elapse of the energization time Ton, for continuing the above alternate energization process. The alternate energization finishing displaced position Vinit corresponds to a second displaced position according to the present invention.

If the detected position Vx has reached the alternate energization finishing displaced position Vinit as determined based on the output signal from the comparator 19 in STEP13 at the time t1 shown in FIG. 4 while the valve opening electromagnet 6 is being energized, then the microcomputer 14 finishes the alternate energization process, forcibly de-energizing the valve opening electromagnet 6 in STEP14. The microcomputer 14 then supplies threshold data to the D/A converter 18 and monitors the output signal from the comparator 19 as with STEP13 thereby to determine whether the detected position Vx of the valve head 3 has reached a predetermined displaced position Vstart near the closed position as shown in FIG. 4 or not in STEP15.

When the valve opening electromagnet 6 is de-energized in STEP14, the amplitude of the vibrations of the valve head 3 has grown sufficient as shown in FIG. 4. After the valve head 3 is slightly moved from the alternate energization finishing displaced position Vinit to the open position due to inertial forces, the valve head 3 moves toward the closed position under the bias of the springs 7, 8, beyond the neutral position under the inertial forces, and reaches the displaced position Vstart (hereinafter referred to as "seating energization starting displaced position Vstart"). The alternate energization finishing displaced position Vinit, which defines the time to finish the alternate energization process, is determined to be such a displaced position that even when the valve head 3 moves from the alternate energization finishing displaced position Vinit toward the open position due to inertial forces, the valve head 3 does not reach the open position, and reaches at least the seating energization starting displaced position Vstart under the bias of the springs 7, 8 and the inertial forces. The seating energization starting displaced position Vstart corresponds to a third displaced position according to the present invention, and is a position between the closed position, which is the initial position of the valve head 3, and the neutral position in the present embodiment.

If the detected position Vx of the valve head 3 has reached the seating energization starting displaced position Vstart in STEP15 at a time t2 shown in FIG. 4, then the microcomputer 14 starts energizing the valve closing electromagnet 5 under constant voltage control, i.e., starts energizing the solenoid 5*a* to make constant the voltage across the solenoid 5*a*, in STEP16. A valve seating process for seating the valve head 3 in its closed position as the initial position is started.

Then, the microcomputer 14 supplies threshold data to the D/A converter 18 and monitors the output signal from the comparator 19 as with STEPS13, 15 while energizing the valve closing electromagnet 5 under constant voltage control, thereby to determine whether the detected position Vx of the valve head 3 has reached a predetermined displaced position Vend (hereinafter referred to as "seating displaced position Vend") that is closer to the closed position than the seating energization starting displaced position Vstart and near the closed position as shown in FIG. 4 or not in STEP17.

When the valve closing electromagnet 5 is energized under constant voltage control, the current supplied to the valve closing electromagnet 5 increases, increasing the electromagnetic forces generated thereby, as the armature 4 approaches the valve closing electromagnet 5. Therefore, the valve head 3 moves smoothly from the seating energization starting displaced position Vstart toward the closed position, and reaches the seating displaced position Vend. The seating displaced position Vend corresponds to a fourth displaced position according to the present invention.

If the detected position Vx has reached the seating displaced position Vend in STEP17 as confirmed in STEP17 at a time t3 in FIG. 4, then the microcomputer 14 switches from the constant voltage control to the constant current control for the energization of the valve closing electromagnet 5 in STEP18. The microcomputer 14 sets the error flag Ffail (see the description of STEP12) to "0" in STEP19, after which the initial actuating process is put to an end. The error flag Ffail set to "0" indicates that the initial actuating process is normally put to an end.

With the energization of the valve closing electromagnet 5 switched from the constant voltage control to the constant current control, the armature 4 is smoothly attracted to the valve closing electromagnet 5 without the possibility of abruptly hitting the valve closing electromagnet 5, and the valve head 3 is smoothly seated in the closed position with relatively small impact sounds.

In the control system according to the first embodiment, as described above, since the delay time Toff is introduced to de-energize the electromagnets 5, 6 in the alternate energization process in the initial actuating process, the valve head 3 can smoothly be brought closely to the open position or the closed position while vibrating together with the armature 4 without having to wastefully energize the electromagnets 5, 6. As a consequence, the consumption of electric energy by the electromagnets 5, 6 while they are being alternately energized is reduced.

Furthermore, because the time to start seating the valve head 3 is determined based on the detected position Vx of the valve head 3 as detected by the displacement sensor 12, the time in which to perform the alternate energization process can be held to a minimum that is required regardless of variations of the properties of the springs 7, 8 of individual solenoid-operated valve devices 11, variations of the friction of various parts at the time the valve head 3 is moved, or time-dependent changes thereof. Moreover, the valve seating process for continuously energizing the valve closing electromagnet 5 can be started at an appropriate time for smoothly seating the valve head 3 in the closed position as the initial position. As a result, the consumption of electric energy by the electromagnets 5, 6 while they are being alternately energized is reduced to a minimum required, and impact sounds which would otherwise be produced if the armature 4 repeatedly hit the valve closing electrode 5 and the valve opening electrode 6 are prevented from being generated.

In the valve seating process, the energization of the valve closing electromagnet 5 is switched from the constant voltage control to the constant current control based on the detected position Vx of the valve head 3. Consequently, the switching from the constant voltage control to the constant current control is carried out at a suitable time, so that impact sounds that are produced are reduced when the valve head 3 is finally seated in the closed position, and the valve head 3 can smoothly be seated in the closed position without having to supply a more current than necessary to the valve closing electromagnet 5.

A second embodiment of the present invention will be described below with reference to FIGS. 5 and 6. A solenoid-operated valve device and a control system according to the second embodiment are identical to those according to the first embodiment, and only a control process according to the second embodiment is different from the control process according to the first embodiment. Therefore, the parts of the solenoid-operated valve device and the control system according to the second embodiment are referred to using the reference characters shown in FIGS. 2 and 3, and will not be described in detail below.

Figure 5:
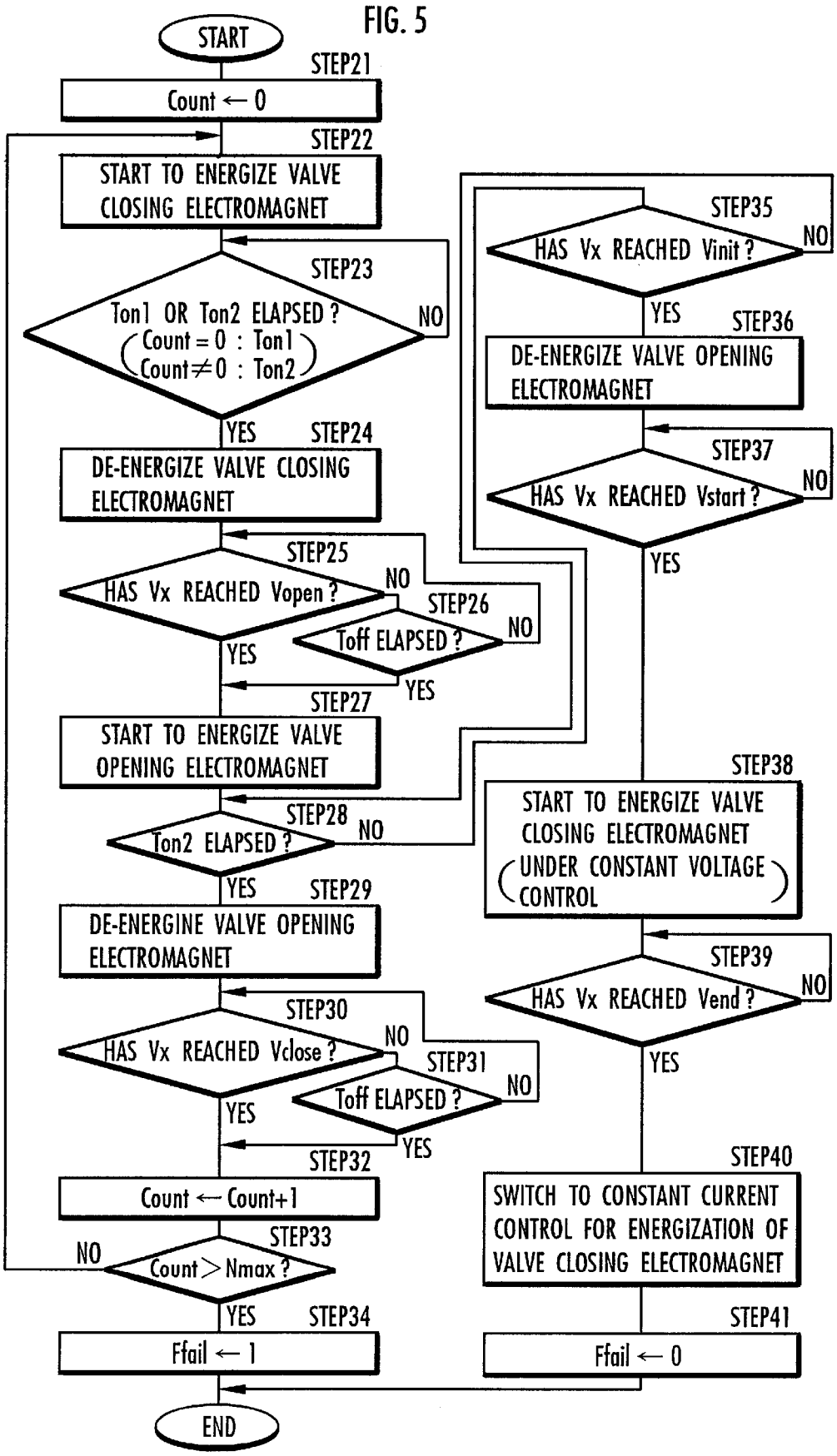
FIG. 5 is a flowchart of a control process according to a second embodiment of the present invention.
Figure 6:
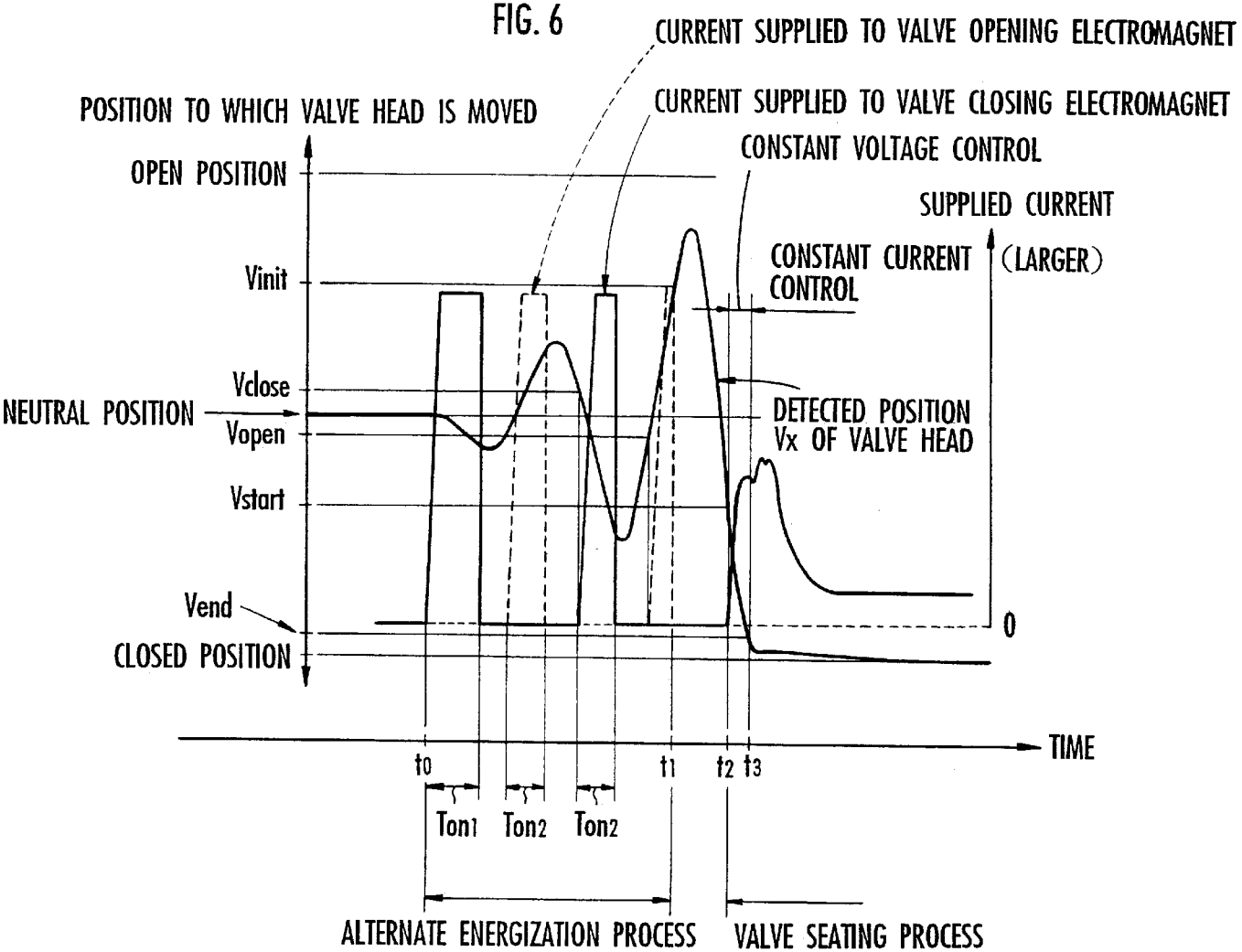
FIG. 6 is a timing chart illustrative of the control process according to the second embodiment of the present invention.

An initial actuating process for the solenoid-operated valve device 11 according to the second embodiment is carried out as shown in a flowchart of FIG. 5 and a timing chart of FIG. 6. FIG. 5 shows a control process performed by the microcomputer 14 in the initial actuating process, and FIG. 6 illustrates how the currents supplied to the electromagnets 5, 6 change with time in the initial actuating process and the output signal Vx of the displacement sensor 12, i.e., the detected position Vx of the valve head 3, changes with time.

In the initial actuating process, as shown in FIG. 5, the microcomputer 14 de-energizes the valve closing and opening electromagnets 5, 6, and initializes the value of a counting parameter Count for counting the number of times that the electromagnets 5, 6 are alternately energized to "0" in STEP21.

Then, the microcomputer 14 performs the processing of a loop from STEP22 to STEP32 to alternately periodically energize the solenoids 5*a*, 6*a*, i.e., performs an alternate energization process.

Specifically, the microcomputer 14 starts energizing the valve closing electromagnet 5 in STEP22, and then monitors whether a predetermined first energization time Ton1 or a predetermined second energization time Ton2 has elapsed from the start of the energization of the valve closing electromagnet 5 or not in STEP23. The first energization time Ton1 is an energization time to be used only when the valve closing electromagnet 5 is first energized, and the second energization time Ton2 is an energization time to be used otherwise when the valve closing electromagnet 5 and the valve opening electromagnet 6 are energized. The first energization time Ton1 is slightly longer than the second energization time Ton2. In STEP23, when the value of the counting parameter Count is "0", the first energization time Ton1 is used, and when Count≠0, the second energization time Ton2 is used.

If the first energization time Ton1 (when Count=0) or the second energization time Ton2 (when Count≠0) has elapsed in STEP23, then the microcomputer 14 de-energizes the valve closing electromagnet 5 in STEP24. After having de-energized the valve closing electromagnet 5, the microcomputer 14 monitors whether the detected position Vx of the valve head 3 as detected by the displacement sensor 12 has reached a predetermined displaced position Vopen (hereinafter referred to as "valve-opening energization starting displaced position Vopen") which is slightly displaced from the neutral position to the closed position as shown in FIG. 6, or not in STEP25. If not, the microcomputer 14 monitors whether a predetermined delay time Toff has elapsed from the de-energization of the valve closing electromagnet 5 or not in STEP26.

If the condition in either STEP25 or STEP26 is satisfied, then the microcomputer 14 starts energizing the valve opening electromagnet 6 in STEP27. Thereafter, the microcomputer 14 monitors whether the second energization time Ton2 has elapsed from the start of the energization of the valve opening electromagnet 6 or not in STEP28.

A decision process in STEP35 is carried out after the valve opening electromagnet 6 starts being energized until the second energization time Ton2 elapses. The decision process in STEP35 will be described in detail later on.

If the second energization time Ton2 has elapsed from the start of the energization of the valve opening electromagnet 6 in STEP28, then the microcomputer 14 de-energizes the valve opening electromagnet 6 in STEP29. The microcomputer 14 then monitors whether the detected position Vx of the valve head 3 as detected by the displacement sensor 12 has reached a predetermined displaced position Vclose (hereinafter referred to as "valve-closing energization starting displaced position Vclose") which is slightly displaced from the neutral position to the open position as shown in FIG. 6, or not in STEP30. If not, the microcomputer 14 monitors whether a predetermined delay time Toff has elapsed from the de-energization of the valve closing electromagnet 5 or not in STEP31.

If the condition in either STEP30 or STEP31 is satisfied, then the microcomputer 14 increments the value of the counting parameter Count by "1" in STEP32. The microcomputer 14 then determines whether the value of the counting parameter Count has exceeded a predetermined upper limit value Nmax or not in STEP33. The microcomputer 14 repeats the processing from STEP22 until the value of the counting parameter Count exceeds the upper limit value Nmax (Count>Nmax).

In STEP 22, the valve closing electromagnet 5 is energized under constant current control, and, in STEP27, the valve opening electromagnet 6 is energized under constant current control.

The valve-opening energization starting displaced position Vopen and the delay time Toff are set to such values that basically after the de-energization of the valve closing electromagnet 5 and before the delay time Toff elapses, the detected position Vx of the valve head 3 reaches the valve-opening energization starting displaced position Vopen. Similarly, the valve-closing energization starting displaced position Vclose used in STEP30, STEP31 are set to such a value that after the de-energization of the valve opening electromagnet 6 and before the delay time Toff elapses, the detected position Vx of the valve head 3 reaches the valve-closing energization starting displaced position Vclose. The valve-opening energization starting displaced position Vopen and the valve-closing energization starting displaced position Vclose correspond to a first displaced position according to the present invention.

If Count>Nmax in STEP33, then the microcomputer 14 sets an error flag Ffail to "1" in STEP34 based on the assumption that the initial actuating process has not been performed properly as with the first embodiment. Then, the initial actuating process is put to an end. At this time, the microcomputer 14 performs a suitable failure process as with the first embodiment.

In the processing of the loop from STEP22 to STEP33, the electromagnets 5, 6 are alternately energized as indicated by the waveforms of the currents supplied to the electromagnets 5, 6 in a period from a time t0 to a time t1 in FIG. 6. While the electromagnets 5, 6 are being energized, the electromagnets 5, 6 apply electromagnetic forces to the armature 4 to attract the armature 4 to themselves. As a result, the armature 4 and the valve head 3 are vertically moved from the neutral position under the electromagnetic forces and the biasing forces of the springs 7, 8.

The energization of the valve closing electromagnet 5, except in the first cycle, begins with a delay from the de-energization of the valve opening electromagnet 6 basically when the valve head 3 reaches the valve-closing energization starting displaced position Vclose on its movement toward the closed position, and is performed while the valve head 3 is in the process of moving toward the closed position, or more specifically, the valve head 3 is in the process of moving from the open position side toward the neutral position under the bias of the springs 7, 8. The energization of the valve opening electromagnet 6 begins with a delay from the de-energization of the valve closing electromagnet 5 basically when the valve head 3 reaches the valve-opening energization starting displaced position Vopen on its movement toward the open position, and is performed while the valve head 3 is in the process of moving toward the open position, or more specifically, the valve head 3 is in the process of moving from the closed position side toward the neutral position under the bias of the springs 7, 8.

Therefore, as with the first embodiment, the valve head 3 and the armature 4 behaves in a resonating manner, and the valve head 3 vibrates together with the armature 4 in substantial synchronism with the alternate energization of the electromagnets 5, 6; between the open position and the closed position with an increasing amplitude, as indicated by the waveform of the detected position Vx of the valve head 3 in FIG. 6. Thus, the valve head 3 moves from the neutral position toward the open position or the closed position while vibrating across the neutral position.

After one of the electromagnets 5, 6 is de-energized until the detected position Vx of the valve head 3 reaches the valve-opening energization starting displaced position Vopen or the valve-closing energization starting displaced position Vclose and the other electromagnet 5 or 6 starts being energized, the valve head 3 moves together with the armature 4 solely under the bias of the springs 7, 8.

Concurrent with the above alternate energization of the electromagnets 5, 6, the microcomputer 14 monitors the detected position Vx of the valve head 3 as detected by the displacement sensor 12 during the period from the start of the energization of the valve opening electromagnet 6 in STEP27 until the elapse of the second energization time Ton2, thus determining whether the detected position Vx has reached an alternate energization finishing displaced position Vinit (see FIG. 6), which is determined in the same manner as with the first embodiment, or not in STEP35.

If the detected position Vx of the valve head 3 has not reached the alternate energization finishing displaced position Vinit, then control goes to STEP29 after elapse of the second energization time Ton2, continuing the alternate energization process.

If the detected position Vx has reached the alternate energization finishing displaced position Vinit as determined based on the output signal from the comparator 19 in STEP35 at the time t1 shown in FIG. 6 while the valve opening electromagnet 6 is being energized, then the microcomputer 14 finishes the alternate energization process, forcibly de-energizing the valve opening electromagnet 6 in STEP36.

Thereafter, the microcomputer 14 performs the same processing (seating process) as the processing in STEP15 through STEP19 in the first embodiment in STEP37 through STEP41, seating the valve head 3 in the closed position as the initial position, after which the initial actuating process is put to an end. Specifically, if the detected position Vx of the valve head 3 has reached the seating energization starting displaced position Vstart (see FIG. 6) on its movement toward the closed position at a time t2 shown in FIG. 6, then the microcomputer 14 starts energizing the valve closing electromagnet 5 under constant voltage control. Thereafter, when the detected position Vx reaches a seating displaced position Vend (see FIG. 6) at a time t3 shown in FIG. 6, the microcomputer 14 switches from the constant voltage control to the constant current control for the energization of the valve closing electromagnet 5. The microcomputer 14 sets the error flag Ffail to "0" based on the assumption that the initial actuating process is normally put to an end.

In the control system according to the second embodiment, as described above, one of the electromagnets 5, 6 is de-energized at a time, and the other electromagnet starts to be energized with a delay from the time at which said one of the electromagnets 5, 6 is de-energized. The time to start to energize the other electromagnet is determined based on the detected position Vx of the valve head 3 as detected by the displacement sensor 12 in the alternate energization process in the initial actuating process. Therefore, the valve head 3 is smoothly moved toward the open position and the closed position while vibrating together with the armature 4 regardless of variations of the properties of the springs 7, 8 of individual solenoid-operated valve devices 11, variations of the friction of various parts at the time the valve head 3 is moved, or time-dependent changes thereof, and the consumption of electric energy by the electromagnets 5, 6 in the alternate energization process is reduced to a minimum required while avoiding wasteful energization of the electromagnets 5, 6.

As with the first embodiment, the time to finish the alternate energization process and the time to start the valve seating process are determined based on the detected position Vx of the valve head 3 as detected by the displacement sensor 12, and the control of the current supplied to the valve closing electromagnet 5 in the valve seating process is switched as with the detected position Vx of the valve head 3. The second embodiment thus offers the same advantages as with the first embodiment with respect to these features.

In the first and second embodiments as described above, the closed position is used as the initial position in which to seat the valve head 3 in the initial actuating process. However, the open position may be used as the initial position. If the open position is used as the initial position, then the alternate energization finishing displaced position Vinit which determines the time to finish the alternate energization process should preferably be close to the closed position for the valve head 3, and the seating energization starting displaced position Vstart which determines the time to start the valve seating process should preferably be close to the open position for the valve head 3.

In the first and second embodiments, the valve closing electromagnet 5 is first energized in the alternate energization process. However, the valve opening electromagnet 6 may first be energized.

In the first embodiment, the energization time Ton and the delay time Toff in the alternate energization process are constant. However, these times may be varied each time the electromagnets 5, 6 are energized or in every period of the alternate energization process. This also holds true for the second embodiment.

In the first and second embodiments, the solenoid-operated valve device for use as an intake or exhaust valve device in an internal combustion engine has been described. However, the principles of the present invention are also applicable to solenoid-operated valve devices for opening and closing other fluid passages.

Although certain preferred embodiments of the present invention have been shown and described in detail, it should be understood that various changes and modifications may be made therein without departing from the scope of the appended claims.

What is claimed is:

1. An apparatus for controlling a solenoid-operated valve device, comprising:

a valve head movable between an open position to open a fluid passage and a closed position to close the fluid passage;

an armature of a magnetic material movable in unison with said valve head;

a valve opening electromagnet energizable for generating electromagnetic forces to attract said armature in a direction to move said valve head toward said open position;

a valve closing electromagnet energizable for generating electromagnetic forces to attract said armature in a direction to move said valve head toward said closed position;

biasing means for biasing said valve head into a neutral position between said open position and said closed position; and control means for performing an alternate energization process to alternately energize said valve opening electromagnet and said valve closing electromagnet periodically to cause said valve opening electromagnet and said valve closing electromagnet to generate electromagnetic forces alternately to vibrate said valve head together with said armature with an increasing amplitude when said valve head is moved from said neutral position in which said valve head is kept by said biasing means to an initial position which is either one of said open position and said closed position;

said control means comprising means for de-energizing one of said valve opening electromagnet and said valve closing electromagnet and thereafter starting to energize the other of said valve opening electromagnet and said valve closing electromagnet with a delay from the time to de-energize said one of the valve opening electromagnet and the valve closing electromagnet in said alternate energization process.

2. An apparatus according to claim 1, wherein said control means further comprises means for de-energizing one of said valve opening electromagnet and said valve closing electromagnet and, after elapse of a predetermined time, starting to energize the other of said valve opening electromagnet and said valve closing electromagnet in said alternate energization process.

3. An apparatus according to claim 1 or 2, wherein said solenoid-operated valve device has:

a displacement sensor for generating an output signal depending on the position to which said valve head is moved;

said control means further comprising means for finishing said alternate energization process when the position to which said valve head is moved, represented by the output signal from said displacement sensor, has reached a second displaced position located closer to either one of said open position and said closed position and between said open position and said closed position after said alternate energization process has been started, and, after said alternate energization process is finished, performing a valve seating process to continuously energize one of said valve opening electromagnet and said valve closing electromagnet which corresponds to said initial position in order to keep said valve head in said initial position.

4. An apparatus according to claim 3, wherein said control means further comprises means for performing said valve seating process by starting to energize the electromagnet corresponding to said initial position under constant voltage control when the position to which said valve head is moved, represented by the output signal from said displacement sensor, has reached a third displaced position located between said open position and said closed position while said valve head is moving toward said initial position after said alternate energization process has been finished, and then energizing the electromagnet corresponding to said initial position under constant current control when the position to which said valve head is moved has reached a fourth displaced position located closer to said initial position than said third displaced position and near said initial position, thus holding said valve head in the initial position.

5. An apparatus according to claim 1, wherein said solenoid-operated valve device has:

a displacement sensor for generating an output signal depending on the position to which said valve head is moved;

said control means further comprising means for de-energizing one of said valve opening electromagnet and said valve closing electromagnet and thereafter starting to energize the other of said valve opening electromagnet and said valve closing electromagnet from the time when the position to which said valve head is moved, represented by the output signal from said displacement sensor, has reached a first displaced position between said open position and said closed position in said alternate energization process.

6. An apparatus according to claim 5, wherein said control means further comprises means for finishing said alternate energization process when the position to which said valve head is moved, represented by the output signal from said displacement sensor, has reached a second displaced position located closer to either one of said open position and said closed position and between said open position and said closed position after said alternate energization process has been started, and, after said alternate energization process is finished, performing a valve seating process to continuously energize one of said valve opening electromagnet and said valve closing electromagnet which corresponds to said initial position in order to keep said valve head in said initial position.

7. An apparatus according to claim 6, wherein said control means further comprises means for performing said valve seating process by starting to energize the electromagnet corresponding to said initial position under constant voltage control when the position to which said valve head is moved, represented by the output signal from said displacement sensor, has reached a third displaced position located between said open position and said closed position while said valve head is moving toward said initial position after said alternate energization process has been finished, and then energizing the electromagnet corresponding to said initial position under constant current control when the position to which said valve head is moved has reached a fourth displaced position located closer to said initial position than said third displaced position and near said initial position, thus holding said valve head in the initial position.

8. A method of controlling a solenoid-operated valve device having a valve head movable between an open position to open a fluid passage and a closed position to close the fluid passage, an armature of a magnetic material movable in unison with said valve head, a valve opening electromagnet energizable for generating electromagnetic forces to attract said armature in a direction to move said valve head toward said open position, a valve closing electromagnet energizable for generating electromagnetic forces to attract said armature in a direction to move said valve head toward said closed position, and biasing means for biasing said valve head into a neutral position between said open position and said closed position, the arrangement being such that an alternate energization process is performed to alternately energize said valve opening electromagnet and said valve closing electromagnet periodically to cause said valve opening electromagnet and said valve closing electromagnet to generate electromagnetic forces alternately to vibrate said valve head together with said armature with an increasing amplitude when said valve head is moved from said neutral position in which said valve head is kept by said biasing means to an initial position which is either one of said open position and said closed position, said method comprising the steps of:

de-energizing one of said valve opening electromagnet and said valve closing electromagnet and thereafter starting to energize the other of said valve opening electromagnet and said valve closing electromagnet with a delay from the time to de-energize said one of the valve opening electromagnet and the valve closing electromagnet in said alternate energization process.

9. A method according to claim 8, further comprising the steps of:

de-energizing one of said valve opening electromagnet and said valve closing electromagnet and, after elapse of a predetermined time, starting to energize the other of said valve opening electromagnet and said valve closing electromagnet in said alternate energization process.

10. A method according to claim 8 or 9, further comprising the steps of:

sequentially detecting the position to which said valve head is moved based on an output signal from a displacement sensor, which is provided in the solenoid-operated valve device to detect the position to which said valve head is moved, at least after said alternate energization process has been started;

finishing said alternate energization process when the detected position to which said valve head is moved has reached a second displaced position located closer to either one of said open position and said closed position and between said open position and said closed position after said alternate energization process has been started, and, after said alternate energization process is finished, performing a valve seating process to continuously energize one of said valve opening electromagnet and said valve closing electromagnet which corresponds to said initial position in order to keep said valve head in said initial position.

11. A method according to claim 10, further comprising the steps of:

performing said valve seating process by starting to energize the electromagnet corresponding to said initial position under constant voltage control when the detected position to which said valve head is moved has reached a third displaced position located between said open position and said closed position while said valve head is moving toward said initial position after said alternate energization process has been finished, and then energizing the electromagnet corresponding to said initial position under constant current control when the detected position to which said valve head is moved has reached a fourth displaced position located closer to said initial position than said third displaced position and near said initial position, thus holding said valve head in the initial position.

12. A method according to claim 8, further comprising the steps of:

sequentially detecting the position to which said valve head is moved based on an output signal from a displacement sensor, which is provided in the solenoid-operated valve device to detect the position to which said valve head is moved, at least after said alternate energization process has been started;

de-energizing one of said valve opening electromagnet and said valve closing electromagnet and thereafter starting to energize the other of said valve opening electromagnet and said valve closing electromagnet from the time when the detected position to which said valve head is moved has reached a first displaced position between said open position and said closed position in said alternate energization process.

13. A method according to claim 12, further comprising the steps of:

finishing said alternate energization process when the detected position to which said valve head is moved has reached a second displaced position located closer to either one of said open position and said closed position and between said open position and said closed position after said alternate energization process has been started, and, after said alternate energization process is finished, performing a valve seating process to continuously energize one of said valve opening electromagnet and said valve closing electromagnet which corresponds to said initial position in order to keep said valve head in said initial position.

14. A method according to claim 13, further comprising the steps of:

performing said valve seating process by starting to energize the electromagnet corresponding to said initial position under constant voltage control when the detected position to which said valve head is moved has reached a third displaced position located between said open position and said closed position while said valve head is moving toward said initial position after said alternate energization process has been finished, and then energizing the electromagnet corresponding to said initial position under constant current control when the detected position to which said valve head is moved has reached a fourth displaced position located closer to said initial position than said third displaced position and near said initial position, thus holding said valve head in the initial position.

15. A computer-readable recording medium storing a control program to enable a computer to control a solenoid-operated valve device having a valve head movable between an open position to open a fluid passage and a closed position to close the fluid passage, an armature of a magnetic material movable in unison with said valve head, a valve opening electromagnet energizable for generating electromagnetic forces to attract said armature in a direction to move said valve head toward said open position, a valve closing electromagnet energizable for generating electromagnetic forces to attract said armature in a direction to move said valve head toward said closed position, and biasing means for biasing said valve head into a neutral position between said open position and said closed position, and also enable the computer to perform an alternate energization process to alternately energize said valve opening electromagnet and said valve closing electromagnet periodically to cause said valve opening electromagnet and said valve closing electromagnet to generate electromagnetic forces alternately to vibrate said valve head together with said armature with an increasing amplitude when said valve head is moved from said neutral position in which said valve head is kept by said biasing means to an initial position which is either one of said open position and said closed position, said control program comprising a program arranged to de-energize one of said valve opening electromagnet and said valve closing electromagnet and thereafter start to energize the other of said valve opening electromagnet and said valve closing electromagnet with a delay from the time to de-energize said one of the valve opening electromagnet and the valve closing electromagnet in said alternate energization process.

16. A recording medium according to claim 15, wherein said control program is arranged to de-energize one of said valve opening electromagnet and said valve closing electromagnet and, after elapse of a predetermined time, start to energize the other of said valve opening electromagnet and said valve closing electromagnet in said alternate energization process.

17. A recording medium according to claim 15 or 16, wherein said computer is capable of detecting the position to which said valve head is moved based on an output signal from a displacement sensor, which is provided in the solenoid-operated valve device to detect the position to which said valve head is moved, said control program including a program for enabling said computer to finish said alternate energization process when the detected position to which said valve head is moved has reached a second displaced position located closer to either one of said open position and said closed position and between said open position and said closed position after said alternate energization process has been started, and, after said alternate energization process is finished, perform a valve seating process to continuously energize one of said valve opening electromagnet and said valve closing electromagnet which corresponds to said initial position in order to keep said valve head in said initial position.

18. A recording medium according to claim 17, wherein said control program is arranged to perform said valve seating process by starting to energize the electromagnet corresponding to said initial position under constant voltage control when the detected position to which said valve head is moved has reached a third displaced position located between said open position and said closed position while said valve head is moving toward said initial position after said alternate energization process has been finished, and then energize the electromagnet corresponding to said initial position under constant current control when the detected position to which said valve head is moved has reached a fourth displaced position located closer to said initial position than said third displaced position and near said initial position, thus holding said valve head in the initial position.

19. A recording medium according to claim 15, wherein said computer is capable of detecting the position to which said valve head is moved based on an output signal from a displacement sensor, which is provided in the solenoid-operated valve device to detect the position to which said valve head is moved, said control program being arranged to de-energize one of said valve opening electromagnet and said valve closing electromagnet and thereafter start to energize the other of said valve opening electromagnet and said valve closing electromagnet from the time when the detected position to which said valve head is moved has reached a first displaced position between said open position and said closed position in said alternate energization process.

20. A recording medium according to claim 19, wherein said control program includes a program to finish said alternate energization process when the detected position to which said valve head is moved has reached a second displaced position located closer to either one of said open position and said closed position and between said open position and said closed position after said alternate energization process has been started, and, after said alternate energization process is finished, perform a valve seating process to continuously energize one of said valve opening electromagnet and said valve closing electromagnet which corresponds to said initial position in order to keep said valve head in said initial position.

21. A recording medium according to claim 19, wherein said control program is arranged to perform said valve seating process by starting to energize the electromagnet corresponding to said initial position under constant voltage control when the detected position to which said valve head is moved has reached a third displaced position located between said open position and said closed position while said valve head is moving toward said initial position after said alternate energization process has been finished, and then energizing the electromagnet corresponding to said initial position under constant current control when the detected position to which said valve head is moved has reached a fourth displaced position located closer to said initial position than said third displaced position and near said initial position, thus holding said valve head in the initial position.

* * * * *